United States Patent [19]

Burkin et al.

[11] 4,301,125

[45] Nov. 17, 1981

[54] EXTRACTION OF PRE-REDUCED LATERITIC ORES WITH AQUEOUS SULPHURIC ACID IN THE PRESENCE OF PEROXIDANT

[75] Inventors: Alfred R. Burkin, Brentwood; Andrew J. Monhemius, Twickenham, both of England

[73] Assignee: Interox Chemicals Ltd., London, England

[21] Appl. No.: 60,762

[22] Filed: Jul. 26, 1979

Related U.S. Application Data

[63] Continuation of Ser. No. 886,436, Mar. 14, 1978, abandoned.

[30] Foreign Application Priority Data

Mar. 31, 1977 [GB] United Kingdom ..... 13544/77
Mar. 31, 1977 [GB] United Kingdom ..... 13545/77

[51] Int. Cl.[3] ..... C22B 23/04; B01D 11/02

[52] U.S. Cl. ..... 423/150; 423/140; 423/146; 423/147

[58] Field of Search ..... 75/82, 101 R, 115, 119; 423/140, 150

[56] References Cited

U.S. PATENT DOCUMENTS

| | | | |
|---|---|---|---|
| 2,197,185 | 4/1940 | Kissock | 75/119 |
| 3,146,091 | 8/1964 | Green | 75/119 |
| 3,738,867 | 6/1973 | Franz | 134/2 |
| 4,096,233 | 5/1979 | Bodson | 423/140 |
| 4,198,377 | 4/1980 | Burkin et al. | 423/140 |

OTHER PUBLICATIONS

Schemb et al., *Hydrogen Peroxide,* Reinhold Pub. Corp., N.Y., (1955) pp. 125, 373, 396, 397, 403, 404, 592–595, 661–664.

*Primary Examiner*—Brian E. Hearn
*Attorney, Agent, or Firm*—Larson and Taylor

[57] ABSTRACT

In a process according to the present invention pre-reduced lateritic ores containing iron and nickel are leached with an aqueous sulphuric acid leach liquor containing or into which is introduced in the presence of the ore a peroxidant selected from hydrogen peroxide and peroxymonosulphuric acid. By so doing, the liquor is obtained with a lower concentration of iron than if the peroxidant had not been employed.

In preferred embodiments the leaching is carried out at from 40° to 70° C. for a period of 1 to 5 hours; when hydrogen peroxide is used, it is preferably introduced continuously or progressively throughout the reaction period and when peroxymonosulphuric acid is used it is preferably introduced initially. The acidity of the liquor can be reduced at the end of the reaction to pH3 to 4 to further lower the content of iron in solution.

3 Claims, No Drawings

EXTRACTION OF PRE-REDUCED LATERITIC ORES WITH AQUEOUS SULPHURIC ACID IN THE PRESENCE OF PEROXIDANT

This is a continuation of application Ser. No. 886,436, filed Mar. 14, 1978, abandoned.

The present invention relates to an hydrometallurgical process for extracting metals from ore and more particularly to the use of a peroxygen compound therein.

In one known method for extracting nickel from laterite ores, the ores are contacted with an aqueous sulphuric acid leach liquor, generally at a temperature of from ambient to 100° C., and often at from 50° C. to 70° C. Laterite ores which are treated in this way have often been pre-reduced, that is to say have had at least part of their metal values reduced to a low or zero oxidation state before being contacted with the leach liquor. Unfortunately, such ores normally contain a considerable proportion of iron, sometimes together with other metals, and only a small proportion of nickel. Since the sulphuric acid leach is non-selective, the resulting leach liquor contains a plurality of metals of which a principal component is iron. In consequence, extensive and costly subsequent operations are required to separate the more valuable component nickel from the dissolved iron. Now, the iron is generally in the ferrous state in the leach liquor with the result that efficient separation cannot be effected by adjustment of the pH, because both ferrous iron and nickel hydroxides precipitate at similar weakly acidic pH's. However, it is in general known that ferric salts precipitate out from solutions under acidic conditions at which nickel remains in solution, so purification of the liquor can be assisted by oxidising the ferrous iron to ferric. Of the oxidants that have been commonly employed in hydrometallurgical processes, air or oxygen in aqueous solution at ambient pressure can oxidise ferrous salts to ferric salts only very slowly at an acidity in the region of pH 2.5 or lower, so that these oxidants can be inconvenient to employ. The other oxidant commonly employed is manganese dioxide, but it will be recognised that even though it can operate successfully under the above-mentioned acid conditions, its use inevitably introduces into solution a manganese salt which itself has to be later separated from the nickel. Thus, the use of manganese dioxide merely exchanges the problem of iron removal to one of manganese removal.

According to the present invention, there is provided a process for the extraction of nickel from pre-reduced ore containing nickel and iron, comprising the step of contacting the pre-reduced ore with an aqueous sulphuric acid leach liquor containing initially or into which is introduced whilst the ore and liquor are in contact a peroxidant selected from peroxymonosulphuric acid and hydrogen peroxide.

We have investigated the effectiveness of the peroxidant as an alternative to oxygen or manganese dioxide with respect to leaching nickel laterite ores with sulphuric acid liquors. We found that when the leach liquors containing dissolved iron and nickel salts are treated after separation from the leached ore, the peroxidant appeared to oxidise the ferrous salts to ferric salts in solution under the acidic conditions, with precipitation of some ferric salt. However, it was readily apparent that the acidity of the leach liquor increased markedly as a result, it is believed, of the oxidation and hydrolysis reaction, leading to the precipitation of ferric hydroxides producing hydrogen ions. A consequence of this increased acidity was that, although the ferrous salts apparently were being oxidised to ferric salts, the precipitation of iron salts was low in comparison with the amount of peroxidant added.

It will be recalled that during conventional leaching of nickel laterite ore with a sulphuric acid leach liquor the amount of iron leached into solution is related to the acidity of the leach liquor. Whilst the absolute value of acid to be used can vary from one ore to another, the trend with respect to treatment of any given ore is that as the acidity rises then so the concentration of iron extracted into the leach liquor rises also. Thus, it would be expected that as ferrous salts were oxidised to ferric by the peroxidant and precipitated out of solution, not only would the acidity of the leach liquor rise, thereby restricting the proportion of ferric salts that could be precipitated, but also that the increased acidity would lead to a further extraction of ferrous salts into solution, thereby negating the desired effect of loss of iron from solution. Surprisingly, we have found that the precipitation efficiency of the peroxidant is markedly better in the presence of the ore than in its absence.

It will be recognised that the process according to the present invention represents a modification of a process in which a sulphuric acid leach liquor free of the peroxidant is employed, called herein the non-oxidising process. In general, and except to the extent disclosed herein, the range of conditions which are or have been used in the non-oxidising process can continue to be used in the invention process, including for example, the total amount of acid required, and the total concentration of acid in the leach liquor, the weight ratio of leach liquor to ore, the leaching period, the temperature and pressure at which leaching is effected, the characteristics of the ore, such as particle size distribution and the apparatus and equipment employed. In general, in addition to reducing the level of iron in the liquor, the use of the peroxidant allows to at least some extent one or both of the following advantages namely a low leaching temperature, and use of atmospheric pressure. It will be understood that some modification to the apparatus and equipment may be desired to operate the process, e.g. to facilitate addition of the peroxidant and that optimum conditions for the invention process within the general ranges can differ somewhat from optimum conditions for the non-oxidising process.

It will be understood that as in the corresponding non-oxidising process the total amount of sulphuric acid to be used will vary from ore to ore, depending upon inter alia the metallic and gangue contents of the ore and the nature of the gangue. In practice, the amount can be determined simply by experiment for each ore to be leached, and the amount so determined used thereafter until operating results indicate that the characteristics of the ore have changed. For a pre-reduced lateritic nickel ore containing from 35–'% iron calculated as FeO, about 1% nickel, about 30% silica, about 5% CaO+MgO and 7% alumina, the amount of acid ion is generally in the range of 0.75 to 1.1 g per 10 g of ore. The amount of acid is the product of the total concentration of acid in solution, and the weight ratio of leach liquor to ore employed.

Now, in general, the rate and extent of leaching of metal values into solution increases as the concentration of acid in the leach liquor is increased, except that, for any given ore, even when the total amount of acid used is suitable, an acid concentration is reached above which any increase does not lead to a significant increase in the extent of leaching of the nickel, but instead merely increases the concentration of impurity metal, iron. In practice, the acid concentration employed is often within ±10% of that concentration since it enables the maximum amount of nickel to be leached without causing excessive leaching of the iron. This concentration can be determined by experiment for each ore to be leached. For the beforementioned lateritic nickel ore, the preferred concentration of sulphuric acid is not more than 20 g/l, advantageously from 10 to 20 g/l, in liquor contacting the ore. As we have described already, we have found that use of the peroxidant results in an increase in the acidity of the solution as the ferric salt precipitates out. In practice, allowance for acidity generated in the course of the iron precipitation can be made by employing a total acid amount and concentration of solely sulphuric acid present initially in the corresponding non-oxidising process. Often, the total acid amount and/or concentration will be calculated within the range of from 75% to 100% of the preferred amount of sulphuric acid present initially in the corresponding non-oxidising process. It will be recognised that when using peroxymonosulphuric acid, sometimes abbreviated herein to PMS the oxidising strength of the leach liquor can be varied by altering the ratio of the two acids, without altering the total amount of acid present initially in the liquor. The ratio is preferably adjusted so that there is at least sufficient PMS present to oxidise all or substantially all the ferrous ions that are leached into solution. Generally this can be achieved by using a solution containing at least 1 mole of PMS per 3 moles of sulphuric acid, often being selected from the range of 1 mole per 1 to 3 moles. Smaller amounts of PMS may be employed but incomplete oxidation of the ferrous ions may result. Greater amounts of PMS can be employed but in practice are not so desirable since the end result is often either an increase in iron content in solution coupled with a decrease in pH or less efficient use of the peroxyacid, or both. In the case of the afore-mentioned laterite ore, the total acid concentration in the leach liquor in the invention process is advantageously from 15 to 20 g/l, of which peroxymonosulphuric acid concentration is especially suitably from 6 to 8 g/l. When the peroxidant comprises hydrogen peroxide the amount present or added is preferably enough to oxidise at least a substantial proportion of the ferrous ions which would be extracted into solution in the non-oxidising process and more desirably sufficient to enable the residual iron content in solution to fall below 1 gpl. The amount of hydrogen peroxide required varies according to the method of use. Although we do not wish to be bound by any one theory, we believe that such variation reflects to a great extent the proportion of hydrogen peroxide that decomposes without effecting oxidation of ferrous to ferric ions in solution and the extent of leaching of additional amounts of ferrous ions into solution. Generally, at least 0.3 mole and often in the range of 0.3 to 1 mole of hydrogen peroxide per mole sulphuric acid is employed.

In a preferred method employing hydrogen peroxide, it is added to leaching solution throughout all or a major proportion of the period that the solution is in contact with the ore. The addition can be continuous, or in incremental additions preferably representing small proportions of the total amount added and occurring regularly, so as to thereby approximate to continuous addition. The effective rate of addition can be varied, if desired, for example varying according to the rate at which ferrous iron is leached into solution. In a modification, a proportion e.g. up to 50% of the hydrogen peroxide can be present initially and the remainder added continuously or incrementally during the leaching period.

When hydrogen peroxide is mixed with or into the leaching liquor, the ferrous ion concentration falls, and there is a tendency for the acidity and the electropotential of the liquor to rise. It is easy to monitor the acidity and potential of a leach liquor continuously. The output, normally an electrical signal proportional to the reading from the monitoring devices, can be employed to control the rate of, and amount of addition of hydrogen peroxide. Thus, for example, the flow of hydrogen peroxide into the leaching vessel can be automatically halted when the potential reaches a predetermined level, which will depend upon the nature of the ore to be leached and the concentration or iron tolerated in the liquor, inter alia. In the case of the nickel laterite ore referred to herein, a suitable potential could be in the range of 500 to 530 mV with respect to saturated calomel electrode, which indicates an iron concentration of about 1 to 0.75 gpl. Alternatively the peroxide flow could be similarly controlled by the output from a pH meter, which in the case of the said nickel laterite ore would mean halting the flow when the pH had fallen to within th pH range of 2.6 to 2.5. In addition, when the pH of the leaching solution reaches about 2.5–3.0, and adjustment to pH 3.0 to 4.0 can be effected, if desired, suitably by addition of an alkali, such as sodium, potassium or ammonium hydroxide, resulting in a further loss of iron from solution. Addition of the alkali can be controlled automatically by the pH meter, e.g. introduction of alkali being permitted only whilst the liquor has a pH within a predetermined range.

Leaching is preferably continued until a predetermined amount of nickel has been extracted which in practice is often substantially all extractable nickel, and advantageously until the iron content of the solution has fallen to a level considered to be accpetable, such as for example below 1 gpl of iron. Often, the leaching period is from 1 to 5 hours.

When sulphuric acid leach liquors containing peroxymonosulphuric acid are employed, the pH of the solution is remarkably low. In general, sufficient acid is present in the leach liquor for its pH to remain below pH 2.5, and on many occasions at or below pH 2.0 when the ore is in contact with leach liquor, particularly during the initial period of about half an hour or so. In the first method of operation, the ore is contacted with the leach liquor for a predetermined period, e.g. from about 20 minutes to one hour, during which time the greater part of the desired metal has been leached into solution, and the pH is then adjusted to within the range of 2.5 to 4.0 preferably 3.0 to 4.0, thereby resulting in a more rapid hydrolysis of the ferric ions in solution and the subsequent precipitation of insoluble ferric hydroxide. Alternatively, in a second method the pH of the solution can be adjusted after a predetermined proportion of the leachable amount e.g. 90 or 95% of the desired metal, nickel, has been dissolved in the leach liquor. The proportion can be determined by resularly sampling the liquor, determining its metal content by, for example, atomic absorption, spectroscopy and comparing the result with the pre-determined leachable amount of the desired metal. A third method of indicating a suitable moment at which the pH of the solution can be adjusted, which can be employed under some circumstances is to monitor the electrode potential from a combined platinum-Ag/AgCl electrode, preferably plotted continuously. Where the ore is added to the leach liquor solution, the graph of the potential against time shows a distinctive peak, after which any change in potential is relatively small and slow. It has been found that by the time the potential has ceased falling rapidly, a substantial proportion of ferrous ions in solution have been oxidised to ferric ions, so that any time thereafter represents a convenient time at which to adjust the pH of the solution to at least 2.5 and preferably at least 3.0.

The pH can be adjusted by mixture with an alkali, such as sodium or potassium hydroxide, or preferably, ammonium hydroxide since local excesses of ammonia hydroxide are relatively tolerable, in that nickel ammines formed in local excesses are also water soluble, so that the risk of nickel values being lost from solution is minimised. Preferably the alkali is in aqueous solution, or in the case of ammonium hydroxide formed by the injection of gaseous ammonia.

The input of the alkali can be controlled manually, or alternatively, the output from the first and third methods of determining when to adjust the pH can be employed to automatically trigger the inflow of alkali, for example actuating a valve opening mechanism. Thus, the output can be from an automatic timer in the first method, or in the third method from a device comparing the instantaneous EMF with the reading at a predetermined time interval earlier and set to trigger when the difference is at or below a preset amount.

Although the pH adjustment can be made by adding a predetermined amount of alkali, it is preferable to add the alkali until a predetermined pH in the range 2.5 to 4.0, as measured by a standard pH meter, is reached and to maintain that pH by further addition of alkali as necessary. It will be recognised that the signal from the pH meter can be coupled to the means for controlling the introduction of alkali so as to automatically regulate the rate and extent of introduction of alkali. Preferably either of the means described hereinbefore to trigger the inflow of alkali is employed to actuate pH control employing output from the pH meter.

The process according to the present invention can be carried out at a temperature between ambient and 100° C., under normal pressure. Higher temperatures and pressures are not needed in general for leaching pre-reduced ores. The invention process is usually effected at a slightly elevated temperature of from 30° C. to 70° C. frequently between 40° C. and 60° C., rather than at ambient, in order to balance the advantage of increased throughput to the apparatus against the disadvantage of increased energy consumption. At temperatures in excess of 40° C., we have found that the ferric salt hydrolyses sufficiently rapidly for it to precipitate out of solution within a reasonable period under the conditions. As an alternative to pH adjustment to 2.5 to 4.0, subsequently the temperature can be maintained from 90° C. to 100° C., at atmospheric pressure, and the pH maintained at approximately 1.5 to 2, together with the introduction of a small amount of alkali, in order to enable the iron salt to precipitate out as a jarosite salt, of general formula $MFe_3(SO_4)_2(OH)_6$ where M is K, Na or $NH_4$, or as a goethite salt. It will be recognised that because the peroxidant is incorporated in the leach liquor whilst the latter is still in the presence of the ore, only a single solid/liquid separation is needed to obtain liquor depleted in unwanted iron, thereby removing the need for a separate purification vessel.

The hydrogen peroxide solution which is introduced into the leach liquor during the leaching stage can have any commercially available concentration, but is normally in the range of from 5 to 65% w/w.

Peroxymonosulphuric acid for use in the invention process can be produced advantageously by reaction between hydrogen peroxide and either sulphuric acid preferably concentrated, or oleum, as described in BP 738407 or BP 844096. The resultant solution contains both sulphuric acid and peroxymonosulphuric acid and the method of manufacture is preferably controlled so as to yield the ratio of peroxymonosulphuric acid to sulphuric acid desired in the leach liquor, or a higher one which can be diluted to the desired ratio by addition of a suitable amount of sulphuric acid. It is highly desirable to use freshly prepared peroxymonosulphuric acid since it can decompose relatively rapidly during storage and thus lead to a diminution in the oxidising power of the solution. Consequently it is preferable for the rate of peroxymonosulphuric acid manufacture to be controlled by the rate at which it is contacted with the ore. This can be effected by using the signal generated by a detector located in the supply line of leach liquor to the ore, which detects the rate of flow of the leach liquor, to control the delivery of sulphuric acid and hydrogen peroxide to the reaction zone. Suitably the signal can be electrical. A signal can be generated that is proportional to the flow rate and when used to control suitable apparatus, such as proportioning pumps, can control the rates at which sulphuric acid and hydrogen peroxide are fed to the reaction zone, or alternatively an all or nothing control system can be employed such as by using a storage tank in the supply line equipped with a pair of detectors of the liquid level, arranged so that when the liquid level falls to the lower level, one detector generates a signal which causes sulphuric acid and hydrogen peroxide to flow into the reaction zone at pre-arranged rates under pumping or by gravity feed constantly until the liquid level rises in the tank to the upper level, whereupon the second detector generates a signal which directs the apparatus to stop the sulphuric acid and hydrogen peroxide flow.

The reaction to produce peroxymonosulphuric acid from hydrogen peroxide and sulphuric acid is exothermic. Thus, by controlling the cooling of the mixture, the mixture of the resultant acid can be controlled, thereby enabling some saving to be made on heating the leach liquor to its desired temperature.

An alternative method of producing peroxymonosulphuric acid is the hydrolysis of a peroxydisulphate, e.g. peroxydisulphuric acid or its sodium, potassium or ammonium salt.

Ores which are particularly suitable for use in a process according to the present invention are limonitic nickel laterite. Such ores commonly have a nickel content, after reduction, in the range of 0.5 to 10%, frequently from 0.5 to 2%, and an iron content as FeO of at least 35% and frequently from 35 to 50%. Other components in the ores include silicate, as $SiO_2$ often in the range of 20 to 35%, alkaline earth metal compounds as the oxide often of up to 10% and alumina often of up to 10%, the percents with respect to the reduced ore being by weight. The ores are normally ground by conventional equipment to give a high proportion—e.g. 90% passing through 200 mesh. They can be reduced conveniently by roasting with lignite, as in the corresponding non-oxidised process. In general, the ores are leached very soon after being reduced, but should they be left for a considerable period of time, i.e. in excess of a day before leaching, then a further advantage of incorporating hydrogen peroxide in the leach liquor becomes apparent, namely that its presence appears to enable a greater proportion of nickel to be extracted than would be the case using solely sulphuric acid at the same pressure and temperature.

The process according to the present invention can conveniently be carried out in apparatus and equipment that could be used for a similar extraction employing solely sulphuric acid. However, since the peroxidant is capable of usually supplying the oxidative needs of the reaction, there is no requirement for the apparatus to distribute large volumes of air through the liquor, so that a fully enclosed system can be employed, for example using a co-current continuous flow technique, desirably with inlets for hydrogen peroxide along the length of the pipe.

After separation from the spent ores, and any precipitated iron salts, the leach liquor can then be subjected to further purification and metal winning steps as in the non-oxidising process. One preferred method of purification is that of solvent extraction, using oximes such as α-hydroxy oxime and benzophenone oxime.

When the hydrogen peroxide is added in only a small number of steps, e.g. 3, the iron content of the liquor can often be reduced to an amount substantially lower than would have been present had an otherwise identical, but hydrogen peroxide-free, leach liquor been contacted with the same ore under the same conditions. However, where the hydrogen peroxide is introduced progressively throughout the leaching period, the number of iron present in solution can be reduced to less than 20% of the comparison, without introduction of any alkali, more efficiently than by addition in only a small number of steps.

When PMS is used in the invention process without any subsequent pH adjustment or similar step, the iron content of the resultant liquor will often be in the range of from 25% to 35% of the amount of iron that would have been present had the same nickel extraction been effected solely by sulphuric acid. However where later pH adjustment to the range pH 3.0 to pH 4.0 is employed the amount of iron present in solution can fall to between 5 to 10% of the comparison.

Having described the invention generally, specific embodiments will now be described more fully by way of example.

In all of the Examples and in the comparison, pre-reduced lateritic nickel ore was used having approximately the following composition percentages being by weight:

| | |
|---|---|
| FeO | 37.5% |
| Ni + Co | 1.1% |
| $SiO_2$ | 29.8% |
| CaO | 0.8% |
| MgO | 3.1% |
| $Al_2O_3$ | 6.5% |

The batch of ore had been stored for approximately 6 months after reduction before leaching.

In Example 1, leaching was effected by charging a round bottomed five-necked split reaction vessel, equipped with an efficient stirrer and a condenser with a sulphuric acid solution (250 ml 20 gpl). The vessel was placed in a water bath controlled to 55° C. and the solution was allowed to equilibrate to that temperature before hydrogen peroxide (5 ml 20 vol) was introduced. A few minutes later the vessel was charged with a sample of the ore (50 g), and 15 minutes and 30 minutes after the first introduction, further portions of hydrogen peroxide (each of 5 ml 20 vol) were introduced, a total of 0.52 moles hydrogen peroxide per mole of sulphuric acid. The mixture was stirred continuously and samples of the liquor were taken periodically, immediately filtered and then diluted with sufficient 0.2 M $H_2SO_4$ to prevent further hydrolysis. The metal contents in the sample were measured by standard atomic absorption techniques. The pH and EMF of the extracting liquor were monitored continuously using a combined glass-calomel electrode and a combined platinum-Ag/AgCl electrode and the results continuously recorded on a two-pen recorder. The data is summarised in Table 1.

TABLE 1

| Time (min) | $H_2O_2$ (ml) (cumulative) | pH | EMF (mV) | [Fe] (g/l) |
|---|---|---|---|---|
| 0 | 5.0 | 0.80 | 45 | — |
| 10 | 5.0 | 4.95 | −225 | 5.92 |
| 15 | 10.0 | 5.10 | −260 | 5.04 |
| 25 | 10.0 | 4.60 | −75 | 4.72 |
| 35 | 15.0 | 3.70 | 150 | 4.08 |
| 65 | 15.0 | 4.30 | 20 | 4.24 |
| 95 | 15.0 | 4.50 | −10 | 3.84 |
| 125 | 15.0 | 4.65 | −35 | 3.60 |
| 155 | 15.0 | 4.75 | −50 | 3.76 |
| 185 | 15.0 | 4.75 | −50 | 3.44 |

In Example 2 a similar procedure of Example 1 was followed, except that the hydrogen peroxide (20 vol) was introduced in small portions (0.1 ml) at minute intervals commencing 17 minutes after introduction of the ore. In Example 3 the procedure was identical to that of Example 2 except that the portions of hydrogen peroxide was 1.0 ml., introduced at 10 minute intervals. It will be noted that the results of Examples 2 and 3 were very similar. The results are summarised in Tables 2 and 3 respectively.

TABLE 2

| Time (min) | $H_2O_2$ (ml) (cumulative) | pH | EMF (mV) | [Fe] (g/l) |
|---|---|---|---|---|
| 0 | 0 | 0.65 | 565 | — |
| 25 | 0.3 | 5.05 | −110 | 6.50 |
| 45 | 2.2 | 4.35 | 40 | 6.20 |
| 65 | 4.2 | 4.15 | 95 | 5.65 |
| 85 | 6.2 | 3.80 | 115 | 4.85 |
| 105 | 8.2 | 3.25 | 260 | 4.10 |
| 125 | 10.0 | 3.00 | 315 | 3.40 |

TABLE 3

| Time (min) | $H_2O_2$ (ml) (cumulative) | pH | EMF (mV) | [Fe] (g/l) |
|---|---|---|---|---|
| 0 | 0 | 0.9 | 550 | — |
| 30 | 0 | 5.8 | −270 | 5.6 |
| 60 | 3.0 | 4.8 | −75 | 5.9 |
| 90 | 6.0 | 4.1 | 120 | 4.9 |
| 120 | 9.0 | 3.3 | 280 | 3.9 |
| 150 | 12.0 | 2.9 | 365 | 2.4 |
| 180 | 15.0 | 2.65 | 450 | 1.35 |
| 210 | 18.0 | 2.55 | 525 | 0.85 |
| 230 | 20.0 | 2.55 | 530 | 0.75 |

From Tables 2 and 3 it can be seen that the precipitation efficiency of the hydrogen peroxide, calculated as amount of iron (in gpl) removed by the addition of each ml of 20 volume hydrogen peroxide was on average, during the period from 30 to 150 minutes after hydrogen peroxide addition began, 0.38. Thereafter, the precipitation efficiency declined, probably due to the increased acidity of the solution.

In Example 4 a similar procedure to Example 1 was followed except that the hydrogen peroxide (20 ml) was introduced into the leach liquor in 0.5 ml aliquots, the EMF being allowed to reach equilibrium before the next aliquot was introduced, resulting in an introduction rate of 0.1 ml per minute. The iron and nickel concentrations were measured after introduction of the ore into the leach liquor, and after the addition of 20 ml of hydrogen peroxide. The iron content had fallen from 6.3 gpl to 0.6 gpl, a reduction of over 90% whereas the nickel content had risen from 1.2 gpl to 1.88 gpl. The precipitation efficiency overall was 0.29. The pH had fallen from 5.5 to 2.2 and the EMF risen from −255 mV to 530 mV.

In the comparison, the procedure of Example 3 was followed, except that the leach liquor was separated from ore after 35 minutes contact and then ore-free liquor treated with aliquots of hydrogen peroxide (20 ml) of 1.0 ml at 10 minute intervals. The results are summarised in Table 4 below, in which precipitation efficiency is expressed as precipitating iron per ml of hydrogen peroxide added.

TABLE 4

| $H_2O_2$ (ml) (cumulative) | [Fe] (g/l) | Precipitation Efficiency |
|---|---|---|
| 0 | 7.2 | — |
| 2 | 6.8 | 0.2 |
| 4 | 6.4 | 0.2 |
| 6 | 5.9 | 0.22 |
| 8 | 5.2 | 0.25 |
| 10 | 5.1 | 0.21 |
| 12 | 4.8 | 0.2 |
| 14 | 4.5 | 0.19 |

EXAMPLES 4 TO 9

In these Examples the apparatus and general method of Example 1 was followed, except that the initial compositions of the sulphuric acid solutions were as summarised in Table 5, and no further amounts of peroxidant were introduced after addition of the ore. In Example 7, aqueous ammonium hydroxide was introduced 23 minutes after the ore, thereby raising the pH to 2.9.

The results of Examples 4–9 are shown respectively in Tables 2 to 7.

TABLE 5

| Example No. | Concentration in the liquor $H_2SO_5$ (g/l) | $H_2SO_4$ (g/l) | Mole Ratio $H_2SO_4$:$H_2SO_5$ |
|---|---|---|---|
| 4 | 8 | 10.3 | 1.5 |
| 5 | 5.6 | 9.6 | 2.0 |
| 6 | 4 | 25 | 7.3 |
| 7 | 6 | 12.7 | 2.5 |
| 8 | 16 | 20.6 | 1.5 |
| 9 | 8 | 10.3 | 1.5 |

TABLE 6

(Example 4)

| Time (min.) | pH | EMF (mV) | [Fe] (g/l) | [Ni] (g/l) |
|---|---|---|---|---|
| 0 | 0.90 | 790 | — | — |
| 5 | 1.65 | 890 | 1.95 | 0.60 |
| 10 | 1.65 | 585 | 2.05 | 0.65 |
| 20 | 1.60 | 530 | 1.90 | 0.65 |
| 30 | 1.45 | 510 | 1.70 | 0.70 |

TABLE 6-continued (Example 4)

| Time (min.) | pH | EMF (mV) | [Fe] (g/l) | [Ni] (g/l) |
|---|---|---|---|---|
| 60 | 1.50 | 470 | 1.50 | 0.70 |
| 90 | 1.80 | 430 | 1.35 | 0.80 |
| 120 | 2.10 | 380 | 1.40 | 0.80 |
| 150 | 2.40 | 340 | 1.55 | 0.90 |
| 180 | 2.40 | 330 | 1.60 | 0.95 |

TABLE 7

(Example 5)

| Time (min.) | pH | EMF (mV) | [Fe] (g/l) | [Ni] (g/l) |
|---|---|---|---|---|
| 0 | 0.70 | 760 | — | — |
| 5 | 1.45 | 650 | 2.25 | 0.74 |
| 10 | 1.50 | 560 | 2.40 | 0.85 |
| 20 | 1.45 | 540 | 2.40 | 0.85 |
| 30 | 1.50 | 515 | 2.35 | 0.85 |
| 60 | 1.40 | 505 | 2.05 | 0.85 |
| 90 | 1.50 | 460 | 1.85 | 1.06 |
| 120 | 1.80 | 410 | 1.70 | 1.01 |
| 150 | 2.15 | 345 | 1.80 | 1.06 |
| 180 | 2.35 | 310 | 1.90 | 1.06 |
| 210 | 2.40 | 305 | 1.90 | 1.06 |

TABLE 8

(Example 6)

| Time (min.) | pH | EMF (mV) | [Fe] (g/l) | [Ni] (g/l) |
|---|---|---|---|---|
| 0 | 0.60 | 790 | — | — |
| 5 | 2.95 | 170 | 11.0 | 1.92 |
| 10 | 2.95 | 195 | 11.0 | 1.92 |
| 20 | 2.90 | 230 | 11.2 | 1.92 |
| 30 | 2.80 | 250 | 11.5 | 2.12 |
| 60 | 2.60 | 280 | 11.5 | 2.02 |
| 90 | 2.40 | 300 | 11.5 | 2.13 |
| 120 | 2.20 | 310 | 11.0 | 2.12 |
| 150 | 2.10 | 310 | 11.5 | 2.12 |
| 180 | 2.05 | 310 | 11.0 | 2.12 |

TABLE 9

(Example 7)

| Time (min.) | pH | EMF (mV) | [Fe] (g/l) | [Ni] (g/l) |
|---|---|---|---|---|
| 0 | 0.90 | 820 | — | — |
| 5 | 1.50 | 990 | 2.00 | 0.68 |
| 10 | 1.45 | 695 | 2.20 | 0.78 |
| 20 | 1.45 | 570 | 2.10 | 0.85 |
| 30 | 2.85 | 400 | 0.75 | 0.85 |
| 60 | 2.95 | 360 | 0.23 | 0.88 |
| 90 | 3.00 | 340 | 0.24 | 0.93 |
| 120 | 3.05 | 320 | 0.29 | 0.95 |
| 150 | 3.10 | 320 | 0.32 | 1.00 |
| 180 | 3.10 | 320 | 0.34 | 1.00 |

TABLE 10

(Example 8)

| Time (min.) | pH | EMF (mV) | [Fe] (g/l) | [Ni] (g/l) |
|---|---|---|---|---|
| 0 | 0.65 | 800 | — | — |
| 5 | 1.10 | 1080 | 5.43 | 1.22 |
| 10 | 1.00 | 740 | 6.06 | 1.41 |
| 20 | 1.10 | 610 | 6.38 | 1.46 |
| 30 | 1.10 | 580 | 6.49 | 1.46 |
| 60 | 1.10 | 580 | 6.76 | 1.55 |
| 90 | 1.20 | 540 | 6.28 | 1.60 |
| 120 | 1.25 | 540 | 6.22 | 1.65 |
| 150 | 1.30 | 530 | 6.06 | 1.70 |
| 180 | 1.30 | 525 | 5.59 | 1.55 |

TABLE 11

| Time (min.) | pH | (Example 9) EMF (mV) | [Fe] (g/l) | [Ni] (g/l) |
|---|---|---|---|---|
| 0 | 0.90 | 800 | — | — |
| 5 | 1.90 | 1000 | 2.05 | 0.82 |
| 10 | 2.00 | 660 | 2.30 | 0.82 |
| 20 | 2.00 | 540 | 2.25 | 0.95 |
| 30 | 1.90 | 510 | 2.20 | 0.95 |
| 60 | 1.70 | 480 | 1.95 | 0.95 |
| 100 | 1.65 | 460 | 1.70 | 1.09 |
| 120 | 1.65 | 450 | 1.60 | 1.09 |
| 155 | 1.75 | 430 | 1.55 | 1.09 |
| 182 | 1.85 | 410 | 1.60 | 1.09 |
| 210 | 2.00 | 390 | 1.60 | 1.09 |

It will be observed that in Examples 1, 2, 4 and 6 the concentration of iron in solution was substantially lower than the amount of 5 to 6 grams/liter that would have been present had the same amount of ore leached with the same volume of leach liquor containing 20 grams/liter sulphuric acid. Moreover, confirmatory tests showed that the iron in solution, after a few minutes was in the ferric state. In Examples 3 and 5, excessive amounts of acid were present initially resulting in much higher concentrations of iron in solution, but the iron concentration would have been still higher had the peroxymonosulphuric acid content been replaced entirely by the same amount of sulphuric acid, giving a concentration of 29 gpl and 36.6 gpl sulphuric acid in Examples 3 and 5 respectively.

We claim:

1. In a process for the extraction of nickel from a prereduced lateritic ore containing after reduction nickel in the zero oxidation state and iron, at least part of which is in the zero oxidation state comprising contacting the prereduced ore with an aqueous sulphuric acid leach liquor, the improvement consisting essentially of maintaining the prereduced ore and leach liquor in contact until at least some nickel has been brought into solution, at a temperature of from 30° to 70° C., the liquor containing peroxymonosulphuric acid or the same being introduced thereinto, in a mole ratio of from 0.3 to 1.0 moles per mole of sulphuric acid, and the sulphuric peroxymonosulphuric acids concentration in total being from 15 to 25 gpl.

2. A process according to claim 1 wherein the leach liquor has an acid concentration of sulphuric and peroxy monosulphuric acids in total of from 15 to 20 gpl, of which the peroxymonosulphuric acid contributes 6 to 8 gpl.

3. A process as claimed in claim 1 wherein the pH of the leach liquor is raised to a pH in the range of 2.5 to 4.0 after the ore and liquor have been in contact for from 20 to 60 minutes or after the electropotential of the liquor has fallen to below its original value.

* * * * *